US008806711B2

(12) United States Patent
Jang

(10) Patent No.: US 8,806,711 B2
(45) Date of Patent: Aug. 19, 2014

(54) AUTOMATIC CLEANER

(71) Applicant: Jaewon Jang, Seoul (KR)

(72) Inventor: Jaewon Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/711,313

(22) Filed: Dec. 11, 2012

(65) Prior Publication Data

US 2013/0152332 A1 Jun. 20, 2013

(30) Foreign Application Priority Data

Dec. 16, 2011 (KR) ..... 10-2011-0136762

(51) Int. Cl.
*A47L 5/10* (2006.01)

(52) U.S. Cl.
USPC ..... 15/385; 15/364; 15/384; 15/389; 15/319; 15/340.4

(58) Field of Classification Search
USPC ..... 15/364, 384, 385, 389, 319, 340.4

IPC ..... A47L 5/10
See application file for complete search history.

(56) References Cited

U.S. PATENT DOCUMENTS

2006/0021168 A1 2/2006 Nishikawa

FOREIGN PATENT DOCUMENTS

JP 2010035773 * 2/2010
JP 2011045694 * 3/2011

* cited by examiner

*Primary Examiner* — David Redding
(74) *Attorney, Agent, or Firm* — McKenna Long & Aldridge LLP

(57) ABSTRACT

An automatic cleaner includes a casing including a suction port, a suction device disposed in the casing to suction a foreign substance through the suction port, a moving device that moves the casing, and a side brush assembly movably installed on the casing. The side brush assembly includes a brush housing rotatable about a first rotation shaft, and a brush rotatably mounted on the brush housing by a second rotation shaft. The second rotation shaft is moved according to a rotation of the brush housing.

17 Claims, 8 Drawing Sheets

AUTOMATIC CLEANER

CROSS-REFERENCE TO RELATED APPLICATIONS

The present application claims priority under 35 U.S.C. 119 and 35 U.S.C. 365 to Korean Patent Application No. 10-2011-0136762 (filed on Dec. 16, 2011), which is hereby incorporated by reference in its entirety.

BACKGROUND

The present disclosure relates to an automatic cleaner.

Cleaners may suction and remove a foreign substance from a cleaning surface. Recently, automatic cleaners for performing an automatic cleaning operation have been introduced. Automatic cleaners are moved by the driving force of a motor powered by a battery to suction and remove a foreign substance from a floor.

In general, a moving device is installed on a casing which defines the appearance of an automatic cleaner. The moving device moves the automatic cleaner in a predetermined direction to suction a foreign substance from a floor. To this end, a suction port is disposed in the bottom of the casing to suction a foreign substance from a floor. A main brush, which directly contacts a foreign substance to suction the foreign substance through the suction port, may be disposed on the suction port.

However, the automatic cleaner suctions only a foreign substance located in a region under the casing, specifically, under the suction port. Thus, it may be difficult to effectively clean a region outside the footprint of the suction port.

To address this issue, a side brush may be disposed on the bottom of the casing. At any one time, at least one portion of the side brush extends outside the footprint of the casing.

The side brush rotates relative to the casing to move a foreign substance located outside the footprint of the casing, specifically, outside the footprint of the suction port, toward the suction port.

However, such automatic cleaners have the following limitations.

As described above, since a foreign substance located outside the footprint of the suction port can be suctioned through the suction port by means of rotation of the side brush, as the length of the side brush is increased, a cleaning area of the automatic cleaner is substantially increased. However, when the length of the side brush is increased, the side brush may be damaged while the automatic cleaner is in a cleaning operation or is stored. In addition, when the length of the side brush is increased, the automatic cleaner requires a large storage space. Thus, it may be inconvenient to store the automatic cleaner.

SUMMARY

In one embodiment, an automatic cleaner includes: a casing including a suction port; a suction device disposed in the casing to suction a foreign substance through the suction port; a moving device that moves the casing; and a side brush assembly movably installed on the casing, wherein the side brush assembly includes a brush housing rotatable about a first rotation shaft, and a brush rotatably mounted on the brush housing by a second rotation shaft, and the second rotation shaft is moved according to a rotation of the brush housing.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
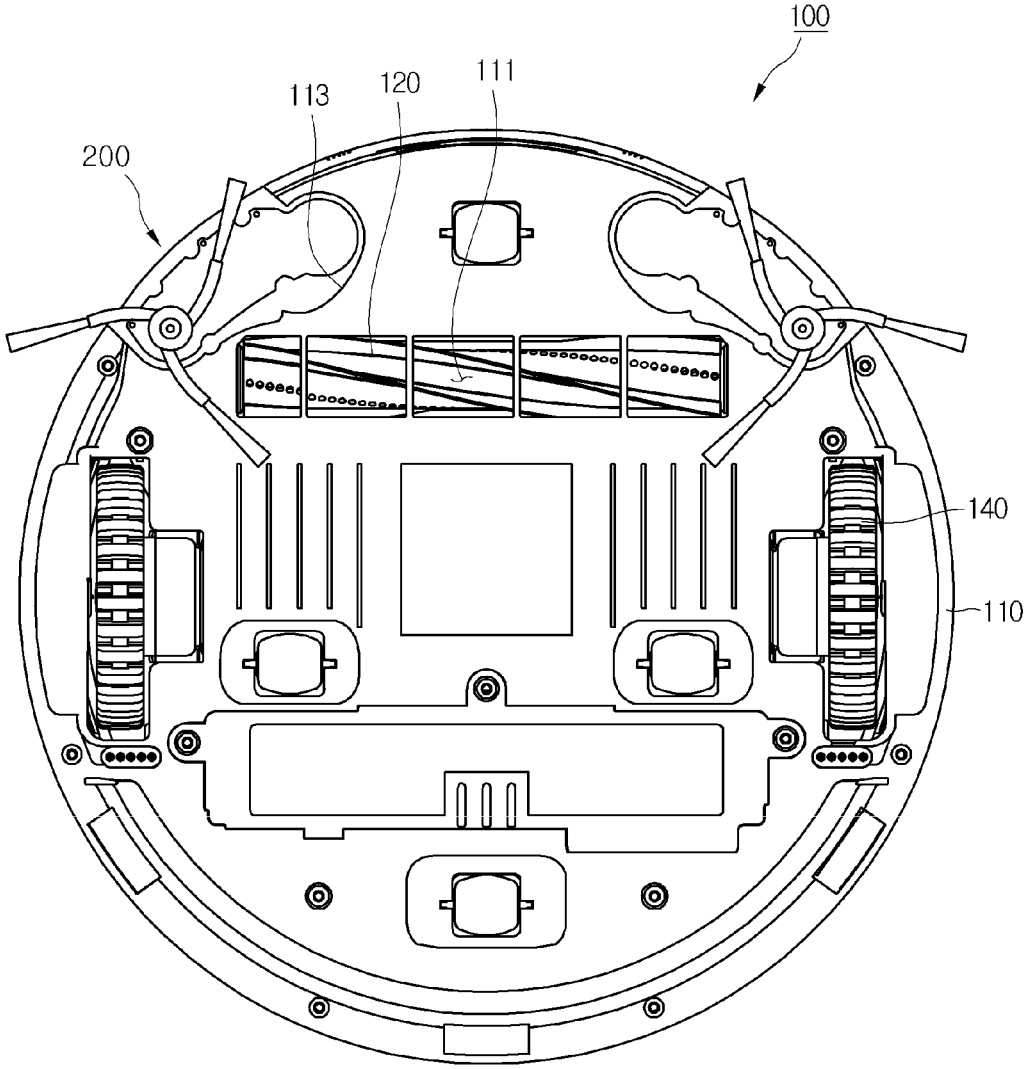
FIG. 1 is a bottom view illustrating an automatic cleaner according to a first embodiment.

FIG. 1 is a bottom view illustrating an automatic cleaner according to a first embodiment.

Referring to FIG. 1, an automatic cleaner 100 according to one embodiment includes a casing 110 that defines the appearance of automatic cleaner 100. Casing 110 may have a flat polyhedral shape, but is not limited thereto. Casing 110 may accommodate various components constituting automatic cleaner 100. For example, a suction device (not shown) for suctioning a foreign substance, and a collecting device (not shown) for collecting the suctioned foreign substance may be disposed in casing 110.

A suction port 111 is disposed in a bottom portion of casing 110. Suction port 111 functions as an inlet through which a foreign substance is suctioned into casing 110, particularly, into the collecting device by the suction device. Suction port 111 may be formed by partially cutting the bottom portion of casing 110.

Seating recesses 113 are disposed in the bottom portion of casing 110. Seating recesses 113 are formed by upwardly recessing a portion of the bottom of casing 110. Although two seating recesses 113 are shown in FIG. 1 being disposed at both sides of suction port 111, the number of seating recesses 113 are not limited thereto.

A main brush 120 is disposed inside of casing 110 on an area corresponding to suction port 111. Main brush 120 passes through suction port 111 to contact a foreign substance on a cleaning target surface and remove the foreign substance.

Main brush 120 is rotatably installed on casing 110. A main driving member (not shown) provides driving force for rotating main brush 120.

Casing 110 is provided with a moving device 140 for moving casing 110. Moving device 140 may include a driving motor (not shown) disposed in casing 110, and wheels rotated by the driving motor.

One or more side brush assemblies 200 are installed on the bottom of casing 110. In at least one embodiment, side brush assembly 200 is provided in plurality on casing 110.

Side brush assemblies 200 are movably installed on casing 110. For example, side brush assemblies 200 may be rotated to be selectively located at a lower side or outside of casing 110.

Side brush assemblies 200 are configured such that the suction device suctions, through suction port 111, a foreign substance located outside the footprint of suction port 111.

Figure 2:
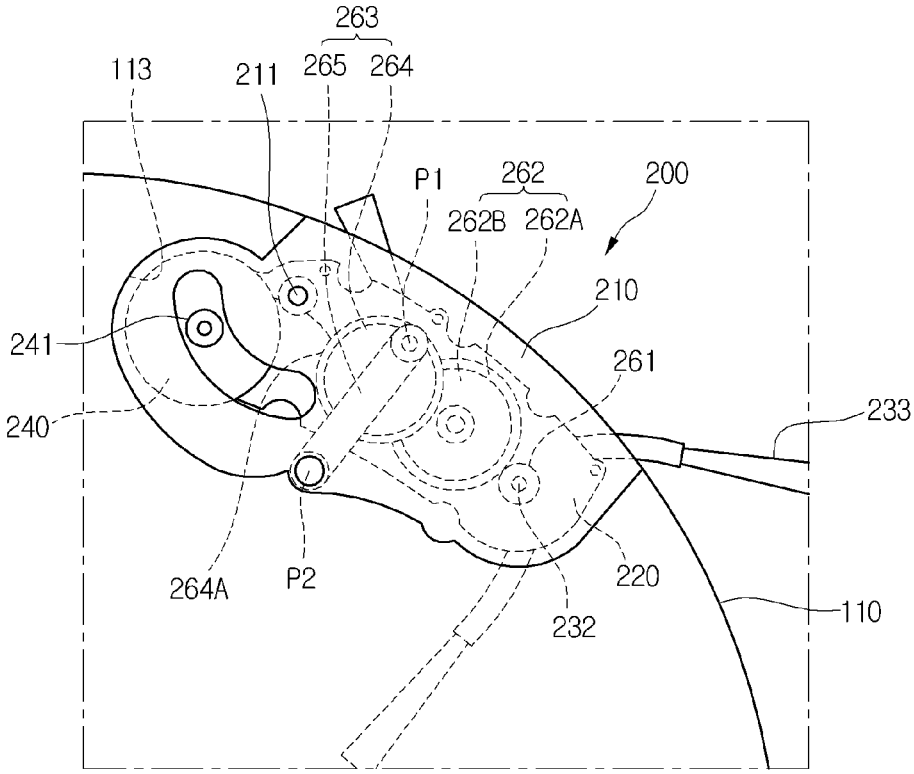
FIG. 2 is a plan view illustrating a side brush assembly according to the first embodiment.
Figure 3:
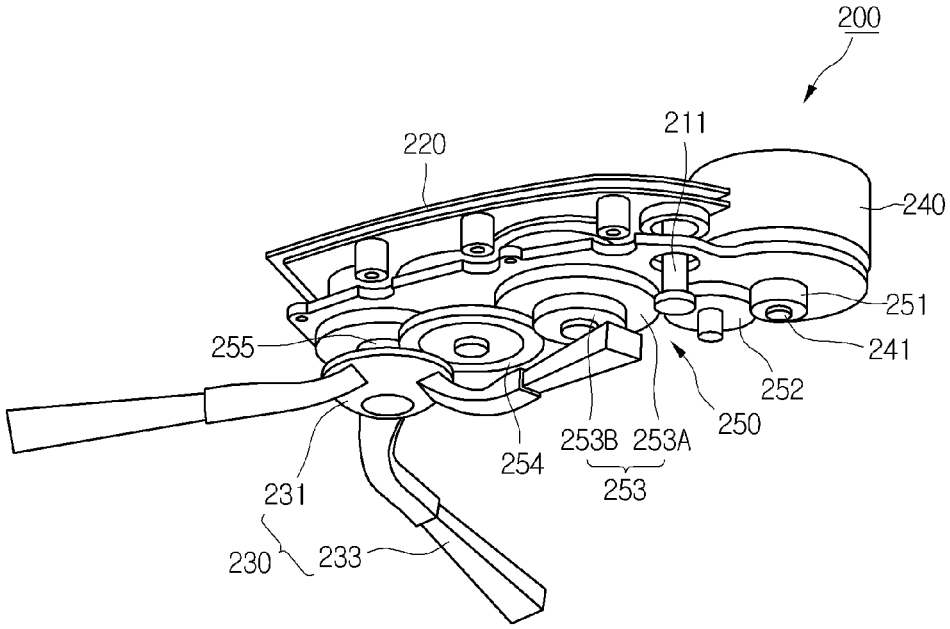
FIGS. 3 and 4 are perspective views illustrating the side brush assembly according to the first embodiment.
Figure 4:
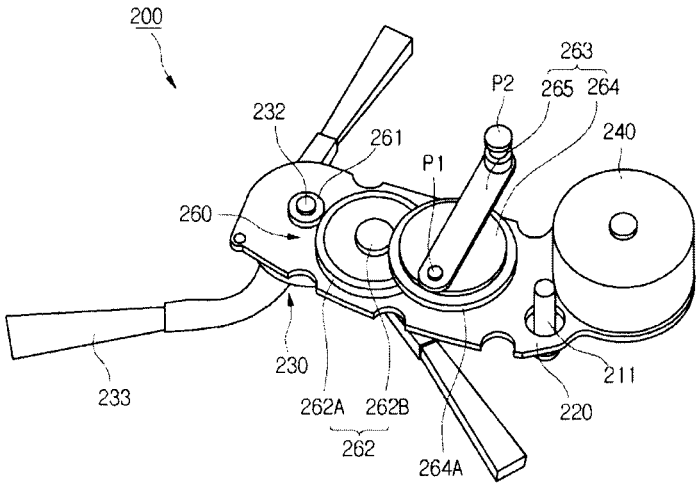

FIG. 2 is a plan view illustrating a side brush assembly according to the first embodiment. FIGS. 3 and 4 are perspective views illustrating the side brush assembly according to the first embodiment.

Referring to FIGS. 2 to 4, side brush assembly 200 may include a brush housing 210, a bracket 220, a brush 230, a driving member 240, and driving force transmission members 250 and 260.

In particular, brush housing 210 may have a hollow polyhedral shape having a cross section corresponding to seating recess 113. Brush housing 210 may be rotatable about a housing rotation shaft 211 (a first rotation shaft), relative to casing 110. Housing rotation shaft 211 vertically extends from a bottom surface of casing 110. Brush housing 210 may be reciprocated along a preset trace about housing rotation shaft 211, relative to casing 110, so that brush housing 210 can be located inside or outside of seating recess 113. Housing rotation shaft 211 is substantially passed through bracket 220 and is rotatably supported by a side portion of casing 110.

Bracket 220 is disposed in brush housing 210. Brush 230, driving member 240, and driving force transmission members 250 and 260 are rotatably supported by bracket 220, or are fixed thereto.

Brush 230 is rotatably installed on a bottom surface of brush housing 210. Brush 230 moves a foreign substance located outside the footprint of suction port 111 to the lower side of suction port 111. Brush 230 includes: a brush holder 231 rotatably installed on bracket 220; and a plurality of bristles 233 fixed to brush holder 231. Brush holder 231 is substantially coupled to the lower end of a brush rotation shaft 232 (a second rotation shaft) fixed to bracket 220 and passed through the bottom of brush housing 210. In one embodiment, the number of bristles 233 may be three, which are fixed to brush holder 231 and are spaced apart from one another by a preset central angle, e.g., about 120°. However, the number of bristles 233 is not specifically limited.

Driving member 240 provides driving force for rotating brush housing 210 relative to casing 110, and rotating brush 230 relative to brush housing 210. In other words, brush housing 210 and brush 230 may be rotated using the driving force from driving member 240. Driving member 240 is fixed to the top surface of bracket 220. That is, driving member 240 is provided on brush housing 210 and is moved together with brush housing 210. Driving member 240 includes a driving shaft 241 rotating to transmit the driving force. When driving member 240 is fixed to the top surface of bracket 220, driving shaft 241 passes through bracket 220 and extends downward.

Driving force transmission members 250 and 260 transmit the driving force from driving member 240 to brush housing 210 and brush 230.

Driving force transmission members 250 and 260 include a first driving force transmission member 250 and a second driving force transmission member 260. First driving force transmission member 250 transmits the driving force from driving member 240, particularly, torque from driving shaft 241 to brush 230. Second driving force transmission member 260 transmits the driving force from driving member 240 to brush housing 210. Second driving force transmission member 260 interacts with rotation of brush 230 to rotate brush housing 210 relative to casing 110. In other words, first driving force transmission member 250 transmits the driving force from driving member 240 to brush 230, and second driving force transmission member 260 transmits torque from brush 230 to brush housing 210.

Referring to FIG. 3, first driving force transmission member 250 may include a driving gear 251 and a plurality of driven gears. The driven gears may include first to fourth driven gears 252, 253, 254, and 255. Driving gear 251 is fixed to driving shaft 241. The first to third driven gears 252, 253, and 254 are rotatably installed on the bottom surface of bracket 220. The fourth driven gear 255 is coupled to brush rotation shaft 232. The fourth driven gear 255 is coupled to a side portion of brush rotation shaft 232 between bracket 220 and brush holder 231. The first driven gear 252 engages with driving gear 251. The second driven gear 253 engages with the first driven gear 252. The second driven gear 253 includes first and second gear parts 253A and 253B that are integrally rotated. The first gear part 253A of the second driven gear 253 is coupled to the first driven gear 252. The third driven gear 254 is coupled to the second gear part 253B of the second driven gear 253. Thus, when driving member 240 is driven, driving force from driving shaft 241 is transmitted to brush rotation shaft 232 through driving gear 251 and the first to fourth driven gears 252, 253, 254, and 255. Gear ratios between driving gear 251 and the first to fourth driven gears 252, 253, 254, and 255 may be appropriately set according to a rotational speed of driving member 240 and a rotational speed of brush 230. Thus, if necessary, the first to third driven gears 252, 253, and 254 may be substantially removed.

Referring to FIG. 4, second driving force transmission member 260 may include fifth and sixth driven gears 261 and 262 and a cam mechanism 263. The fifth driven gear 261 is coupled to the upper end of brush rotation shaft 232 over bracket 220. The sixth driven gear 262 is rotatably installed on the top surface of bracket 220. The sixth driven gear 262 includes first and second gear parts 262A and 262B that are integrally rotated. The first gear part 262A of the sixth driven gear 262 engages with the fifth driven gear 261. Cam mechanism 263 provides a preset trace along which brush housing 210 is reciprocated relative to casing 110 according to rotation of the sixth driven gear 262.

Cam mechanism 263 includes a rotation cam 264 and a link member 265. In particular, rotation cam 264 is rotatably installed on the top surface of bracket 220. Rotation cam 264 includes a gear part 264A. The gear part 264A engages with the second gear part 262B of the sixth driven gear 262. In at least one embodiment, the fifth and sixth driven gears 261 and 262 may be removed, and rotation cam 264 may be coupled to the upper end of brush rotation shaft 232. A first hinge pin P1 is disposed on a surface of rotation cam 264. The first hinge pin P1 is spaced a preset distance from a rounded center of rotation cam 264. Thus, when rotation cam 264 is rotated, first hinge pin P1 rotates to form a preset trace.

An end of the link member 265 is hinged to the first hinge pin P1. The other end of link member 265 is hinged to a second hinge pin P2 fixed to casing 110. Thus, the link member 265 is moved according to rotation of rotation cam 264 so as to provide the preset trace along which brush housing 210 is reciprocated relative to casing 110. As such, since cam mechanism 263 delimits a rotation range of brush housing 210, cam mechanism 263 may be referred to as a rotation range delimitation member.

Figure 5:
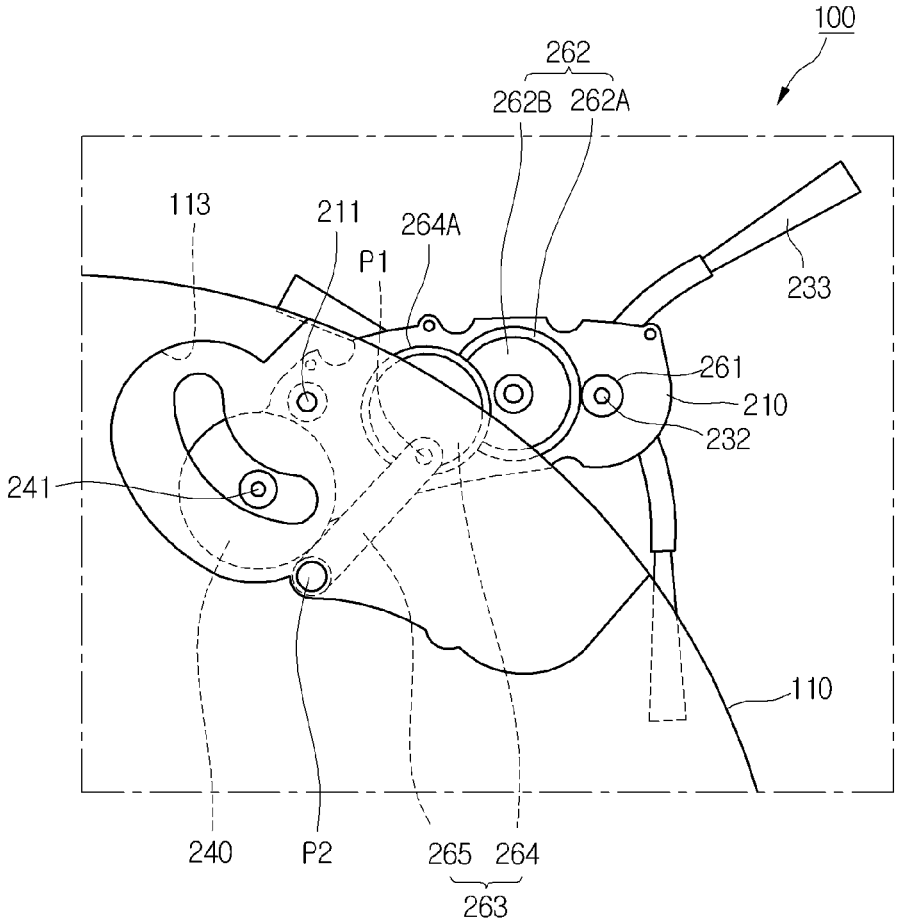
FIG. 5 is a plan view illustrating an operation of the side brush assembly according to the first embodiment.

Side brush assembly 200 may be located in a first position (refer to FIG. 2) according to a rotation of brush housing 210 relative to casing 110, or be reciprocated between the first and second positions (refer to FIG. 5). Side brush assembly 200 is located under casing 110 in the first position, that is, is accommodated within seating recess 113 in the first position. In this case, a vertical projection of brush housing 210 is located within a vertical projection of casing 110. In the second position, at least one portion of side brush assembly 200 is located outside of casing 110 in the second position. When side brush assembly 200 is located in the second position, a portion of a vertical projection of brush housing 210 is located outside of a vertical projection of casing 110, and the rest of the vertical projection of brush housing 210 is located within the vertical projection of casing 110. Alternatively, when side brush assembly 200 is in the first position, a portion of the vertical projection of brush 230 may be located outside of the vertical projection of casing 110.

According to whether automatic cleaner 100 is in a cleaning operation, side brush assembly 200 may be located in the first position, or be reciprocated between the first and second positions. Thus, a vertical overlap area between brush housing 210 and casing 110 may be varied according to movements of side brush assembly 200 (or brush housing 210).

The cleaning operation may be an operation of the suction device. That is, when automatic cleaner 100 is not in the cleaning operation, side brush assembly 200 is in the first position. When the cleaning operation is started, side brush assembly 200 is rotated in a reciprocating motion between the first and second positions. That is, with respect to driving member 240, an operation of driving member 240 for reciprocating side brush assembly 200 between the first position to the second position may be performed between the start and stop of an operation of the suction device.

FIG. 5 is a plan view illustrating an operation of a side brush assembly according to the first embodiment.

Referring to FIG. 1, when automatic cleaner 100 is not in the cleaning operation, that is, when automatic cleaner 100 is stored or charged, side brush assembly 200 is in the first position. Thus, side brush assembly 200 is located under (or inside of) the casing 110 and is thus not exposed outside of casing 110. A portion of side brush assembly 200 may be protruded outside the footprint of casing 110, but the area of the protruded portion may be smaller than the portion under casing 110.

Since side brush assembly 200 is located under the casing 110, a space for storing automatic cleaner 100 can be decreased. Furthermore, when brush 230 is located under casing 110, the possibility of damage to brush 230 can be decreased while automatic cleaner 100 is stored.

In this state, when the cleaning operation is started, an operation of the suction device is started to suction a foreign substance through suction port 111. Additionally, moving device 140 is operated to move automatic cleaner 100, thereby performing the cleaning operation.

When the operation of the suction device is started, driving member 240 is operated. Thus, driving force from driving member 240 is transmitted to brush 230 through driving gear 251 and the first to fourth driven gears 252, 253, 254, and 255. Accordingly, brush 230 is rotated about brush rotation shaft 232.

When brush rotation shaft 232 is rotated, the driving force is transmitted to cam mechanism 263 through the fifth and sixth driven gears 261 and 262. In particular, when torque from brush 230 is transmitted to rotation cam 264 through the fifth and sixth driven gears 261 and 262, rotation cam 264 is rotated to move link member 265, thereby rotating brush housing 210 about housing rotation shaft 211, relative to casing 110. As a result, as illustrated in FIGS. 1 and 5, cam mechanism 263 rotates side brush assembly 200 along a preset trace about housing rotation shaft 211, relative to casing 110. Accordingly, side brush assembly 200 is reciprocated between the first and second positions. As such, while brush housing 210 is reciprocated relative to casing 110, brush 230 is rotated relative to brush housing 210, thereby guiding a foreign substance to suction port 111.

Figure 6:
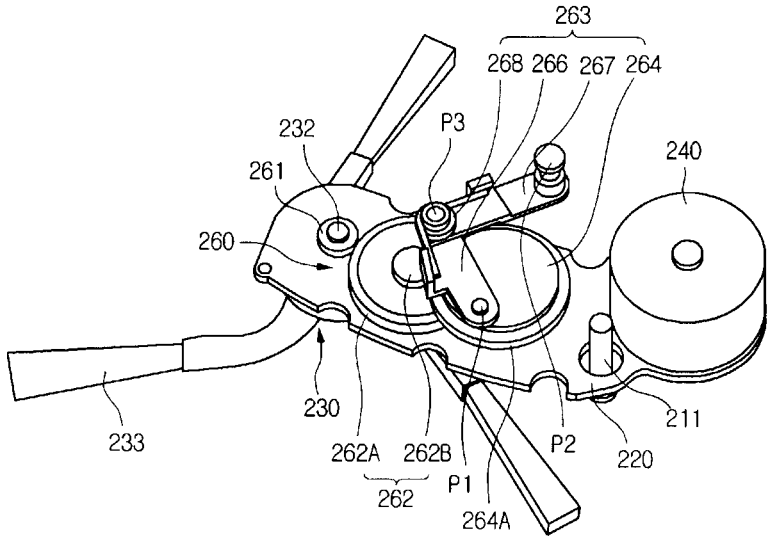
FIG. 6 is a perspective view illustrating a side brush assembly according to a second embodiment.
Figure 7:
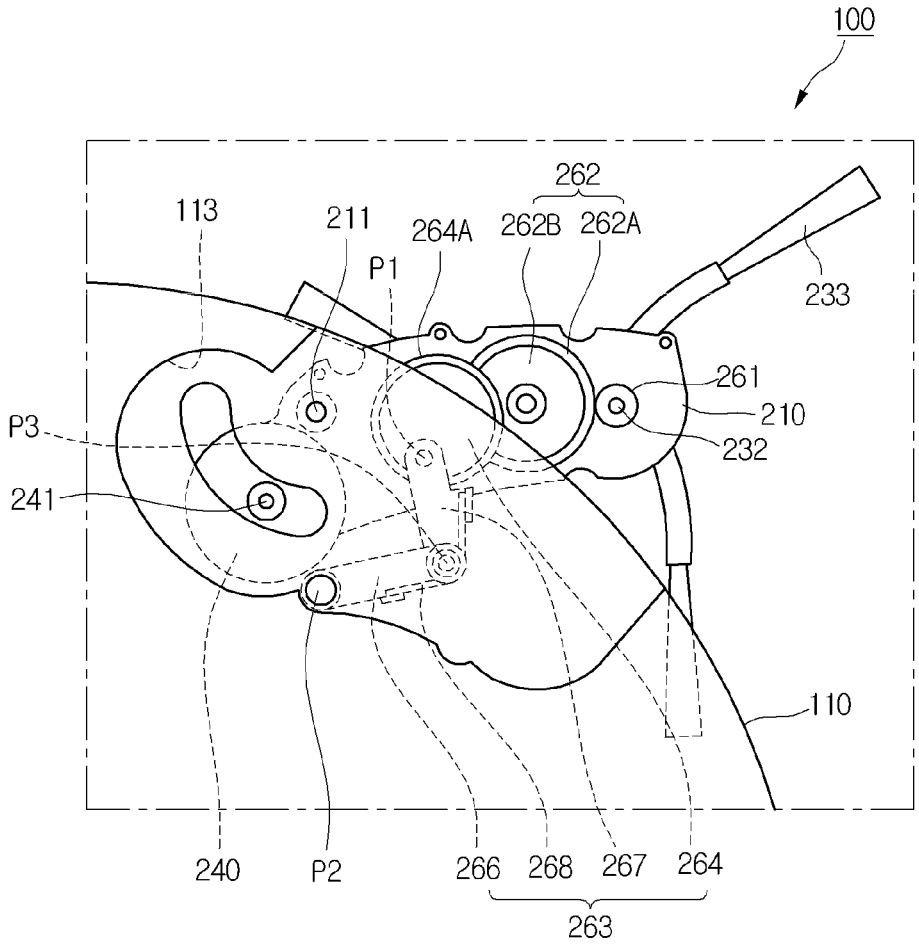
FIG. 7 is a plan view illustrating an operation of the side brush assembly according to the second embodiment.

FIG. 6 is a perspective view illustrating a side brush assembly according to a second embodiment. FIG. 7 is a plan view illustrating an operation of the side brush assembly according to the second embodiment. Like reference numerals denote like elements in the first and second embodiments, and a description of the same components as those of the first embodiment will be omitted in the second embodiment.

Referring to FIG. 6, a cam mechanism 263 according to at least one embodiment includes a rotation cam 264, first and second link members 266 and 267, and an elastic member 268. Rotation cam 264 is substantially the same as that of the first embodiment. The first and second link members 266 and 267 and elastic member 268 may be buffer members for absorbing shock applied to a brush housing 210.

An end of the first link member 266 is hinged to a first hinge pin P1 provided on rotation cam 264. The other end of the first link member 266 and an end of the second link member 267 are hinged to each other through a connecting pin P3. The other end of the second link member 267 is hinged to a second hinge pin P2 fixed to a casing 110.

Elastic member 268 provides elastic force to the first or second link members 266 or 267 to maintain a preset angle between the first and second link members 266 and 267. For example, elastic member 268 may provide elastic force to the first and second link members 266 and 267 to rotate the first link member 266 clockwise, on the basis of FIG. 6, about connecting pin P3 and rotate the second link member 267 counterclockwise about connecting pin P3. That is, since elastic member 268 provides elastic force to the first and second link members 266 and 267, the ends of the first and second link members 266 and 267, hinged to the connecting pin P3, operate substantially in the form of a rigid joint. Thus, according to rotation of rotation cam 264, the first and second link members 266 and 267 are moved with a preset angle maintained therebetween, so as to provide a preset trace along which brush housing 210 is reciprocated relative to casing 110.

Elastic member 268 may be a torsion spring installed on connecting pin P3 and having both ends supported by the first and second link member 266 and 267, respectively. However, such a torsion spring is just an example of elastic member 268, and thus, elastic member 268 is not limited to a torsion spring.

Referring to FIG. 7, while brush housing 210 is rotated relative to casing 110, external force may be applied to brush housing 210. At this point, the first and second link members 266 and 267 may rotate about connecting pin P3, overcoming the elastic force of elastic member 268. Thus, side brush assembly 200, and in particular, driving member 240 is protected from the external force applied to brush housing 210. When the external force is removed, the elastic force of elastic member 268 moves the first and second link members 266 and 267 to a position where the preset angle is maintained, as illustrated in FIG. 7.

Figure 8:
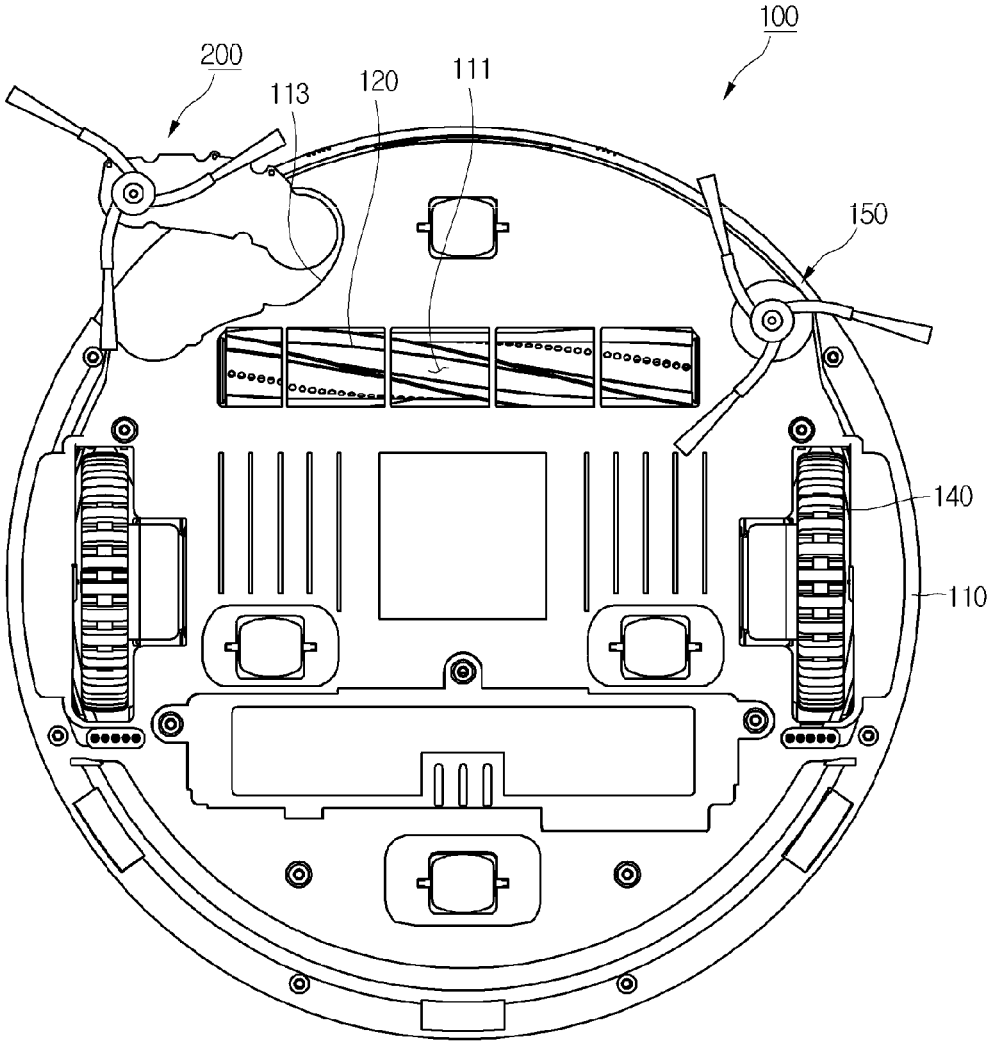
FIG. 8 is a bottom view illustrating an automatic cleaner according to a third embodiment.

FIG. 8 is a bottom view illustrating an automatic cleaner according to a third embodiment. Like reference numerals denote like elements in the first and third embodiments, and a description of the same components as those of the first embodiment will be omitted in the third embodiment.

Referring to FIG. 8, a side brush assembly 200 is disposed on a side of the bottom surface of a casing 110, and a side brush 150 is disposed on another side thereof. Side brush assembly 200 is substantially the same as that of the first or second embodiment. Side brush 150 may be substantially the same as a typical side brush.

As such, a configuration in which different types of side brushes are disposed at both sides of a suction port 111 is appropriate for an automatic cleaner rotating only in one direction. For example, when casing 110 which is linearly moving in a direction approaches an obstacle such as a wall, on the basis of FIG. 8 the left side of casing 110 may be substantially rotated about the right side thereof, that is, may be rotated clockwise. While casing 110 is rotated, a trace formed by the left side of casing 110 is adjacent to the obstacle. In this case, since side brush assembly 200 is disposed on the left side of casing 110, a foreign substance between casing 110 and the obstacle is efficiently removed Meanwhile, during the rotation of casing 110, a region corresponding to a trace formed by the right side of casing 110 overlaps a region corresponding to a linear movement of casing 110. Thus, even though side brush 150 as a typical side brush is disposed on the right side of casing 110, cleaning efficiency is not degraded.

According to the above embodiment, power from driving member 240 is transmitted to brush housing 210 through brush 230. However, power from a driving member may be individually and directly transmitted to a brush and a brush housing. That is, driving force from a driving member may be transmitted to a brush through a first driving force transmission member, and be directly transmitted to a brush housing through a second driving force transmission member.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. An automatic cleaner comprising:
a casing comprising
a suction port;
a suction device disposed in the casing to suction a foreign substance through the suction port;
a moving device that moves the casing; and
a side brush assembly movably installed on the casing,
wherein the side brush assembly comprises
a brush housing rotatable about a first rotation shaft,
a brush rotatably mounted on the brush housing by a second rotation shaft, and
a single driving member configured to rotate the brush housing with respect to the first rotation shaft and to rotate the brush with respect to the second rotation shaft, and
the second rotation shaft is moved according to a rotation of the brush housing.

2. The automatic cleaner of claim 1, further comprising:
a first driving force transmission member that transmits driving force from the single driving member to the brush; and
a second driving force transmission member that transmits driving force from the single driving member to the brush housing.

3. The automatic cleaner of claim 2, wherein the first driving force transmission member comprises a plurality of gears.

4. The automatic cleaner of claim 2, wherein the second driving force transmission member is connected to the second rotation shaft.

5. The automatic cleaner of claim 2, wherein the second driving force transmission member comprises at least one gear and a cam mechanism connected to the at least one gear.

6. The automatic cleaner of claim 5, wherein the cam mechanism comprises
a rotation cam and a link member connected to the rotation cam, and
an end of the link member is rotatably coupled to the casing.

7. The automatic cleaner of claim 5, wherein the link member comprises
a first link member,
a second link member, and
an elastic member that provides elastic force to the first or second link member.

8. The automatic cleaner of claim 1, further comprising
a rotation range delimitation member for rotating the brush housing within a predetermined angle range.

9. The automatic cleaner of claim 8, wherein the rotation range delimitation member comprises
a rotation cam provided on the brush housing, and a link member connected to the rotation cam, and
an end of the link member is connected to the casing.

10. The automatic cleaner of claim 9, further comprising
an elastic member elastically supporting the link member.

11. The automatic cleaner of claim 1, further comprising
a buffer member that absorbs shock applied to the brush housing.

12. The automatic cleaner of claim 11, wherein the buffer member comprises:
a link member provided on the brush housing; and
an elastic member that provides elastic force to the link member.

13. The automatic cleaner of claim 12, wherein the link member comprises
a first link member connected to the brush housing, and
a second link member connected to the casing, and
the elastic member provides elastic force to the second link member.

14. The automatic cleaner of claim 1, wherein a vertical overlap area between the brush housing and the casing is varied according to a rotation of the brush housing.

15. An automatic cleaner comprising:
a casing comprising
a suction port through which a foreign substance is suctioned,
a moving device that moves the casing; and
a side brush assembly movably installed on the casing,
wherein the side brush assembly comprises:

a brush housing movably connected to the casing;

a brush rotatably mounted on the brush housing;

a single driving member configured to rotate the brush housing with respect to a first shaft and to rotate the brush with respect to a second shaft; and a movement range delimitation member to move the brush housing within a predetermined movement range, wherein the brush housing is reciprocated within the predetermined movement range during the single driving member is operated.

16. The automatic cleaner of claim 15, wherein the movement range delimitation member comprises a rotation cam provided on the brush housing, and a link member connected to the rotation cam, and an end of the link member is connected to the casing.

17. An automatic cleaner comprising:

a casing comprising a suction port through which a foreign substance is suctioned, a moving device that moves the casing;

a brush housing movably connected to the casing;

a brush rotatably mounted on the brush housing;

a single driving motor configured to drive the brush housing and the brush such that the brush rotates with respect to a second shaft;

a first transmission member that transmits driving force from the driving member to the brush; and a second transmission member that transmits driving force from the driving member to the brush housing such that the brush housing rotates with respect to the first a shaft.

* * * * *